United States Patent [19]

Sugio et al.

[11] Patent Number: 4,538,963

[45] Date of Patent: Sep. 3, 1985

[54] IMPELLER FOR CROSS-FLOW FAN

[75] Inventors: Takashi Sugio, Kusatsu; Makoto Obata; Shotaro Ito, both of Shiga, all of Japan

[73] Assignee: Matsushita Electric Industrial Co., Ltd., Kadoma, Japan

[21] Appl. No.: 627,724

[22] Filed: Jul. 3, 1984

[30] Foreign Application Priority Data

Jul. 8, 1983 [JP] Japan ..... 58-125049

[51] Int. Cl.[3] ..... F04D 29/66

[52] U.S. Cl. ..... 416/203; 415/119; 416/500

[58] Field of Search ..... 416/203, 500; 415/119

[56] References Cited

U.S. PATENT DOCUMENTS

| | | | |
|---|---|---|---|
| 1,893,184 | 1/1933 | Smellie | 416/203 X |
| 2,006,684 | 7/1935 | Meininghaus | 416/203 X |
| 3,006,603 | 10/1961 | Caruso et al. | 416/203 X |
| 3,058,528 | 10/1962 | Hiersch | 416/203 |
| 3,156,408 | 11/1964 | Whitenack | 416/203 X |
| 3,342,254 | 9/1967 | Fujie | 416/203 X |
| 3,398,866 | 8/1968 | La Flame et al. | 416/203 X |
| 3,536,417 | 10/1970 | Stiefel et al. | 416/203 X |
| 4,253,800 | 3/1981 | Segawa et al. | 416/203 |

FOREIGN PATENT DOCUMENTS

| | | | |
|---|---|---|---|
| 83294 | 3/1921 | Austria | 416/203 |
| 1177277 | 9/1964 | Fed. Rep. of Germany | 416/203 |
| 1293553 | 10/1972 | United Kingdom | 416/203 |
| 2046360 | 11/1980 | United Kingdom | 416/203 |
| 2054058 | 2/1981 | United Kingdom | 416/203 |

*Primary Examiner*—Everette A. Powell, Jr.

*Attorney, Agent, or Firm*—Wenderoth, Lind & Ponack

[57] ABSTRACT

An impeller for a cross-flow fan, including a plurality of impeller sections. Each impeller sections includes a pair of plate members and a number of blades extending between and circumferentially of the plate members such that the blades are circumferentially spaced at random pitch angles without periodicity.

5 Claims, 7 Drawing Figures

IMPELLER FOR CROSS-FLOW FAN

BACKGROUND OF THE INVENTION

The present invention generally relates to fans and more particularly, to an impeller for a cross-flow fan which is widely used as a fan for an air-conditioner or the like.

Conventionally, in cross-flow fans, it has been so arranged as shown in FIG. 1 that a stabilizer 2 and a rear guider 3 are, respectively, disposed forwardly of and rearwardly of an impeller 1. The impeller 1 has a pair of disk-like end plates 4 disposed at opposite ends thereof and a plurality of disk-like or annular partition plates 5 interposed between the end plates 4. Adjacent ones of the end plates 4 and the partition plates 5 are spaced at a predetermined interval so as to be coupled, along outer peripheral portions thereof, with each other by a number of blades 6.

Since the cross-flow fans generally have such structural features as to produce an air flow incapable of being achieved by fans of other types, that, is an inflow direction and an outflow direction of air which are opposite to each other as shown by the arrows of FIG. 1, and an air flow which increases substantially in proportion to lengths of the cross-flow fans upon axial extension thereof, the cross-flow fans have come into general use for air-conditioners, etc. in recent years.

However, the known cross-flow fans have such disadvantages that high frequency noises are produced and their efficiency is rather low. Regarding the noises, the prior art cross-flow fans have such an inconvenience that highfrequency peculiar noises, i.e. so-called nz noises are readily generated, which are produced by interference between the stabilizer 2 and the blades 6 of the impeller 1 and whose frequency is expressed by a product of n·z (n and z denoting the rate of revolutions of the impeller 1 and the number of the blades 6, respectively). Although the nz noises are peculiar noises experienced widely also in fans of other types, frequencies of the nz noises rise especially in the cross-flow fans so high as to be extremely disturbing for human ears like whistling sounds.

Although the pitch of the nz noises varies according to shapes or relative positions of the impeller 1, stabilizer 2 and rear guider 3, loads, etc., the design for repressing the nz noises frequently runs counter to the design for raising the fan efficiency. For example, it is already well known that a minimum distance y (FIG. 1) between the stabilizer 2 and the impeller 1 is an essential factor for determining the performance of the cross-flow fans. In the case where the minimum distance y is reduced, the efficiency rises but the nz noises become undesirably large. Thus, the known cross-flow fans have such a drawback that, in order to repress the nz noises, the efficiency cannot be raised as high as might be desired.

Furthermore, in the prior art impeller 1, since the blades 6 are arranged at a uniform pitch angle $\theta$ (=360/z deg.) as shown in FIG. 2, interference noises due to interference between the blades 6 and the stabilizer 2 are produced at a uniform interval as shown in FIG. 4*a*, so that the interference noises produced by all the blades 6 have an identical frequency characteristic and thus, the noise level becomes extremely high at a frequency of nz.

SUMMARY OF THE INVENTION

Accordingly, an essential object of the present invention is to provide, by taking it into account that a frequency of interference noises produced by interference between blades and a stabilizer is represented by $360 \times n/\theta$ (n and $\theta$ denoting the number of the blades and a mounting pitch angle of the blades, respectively), an improved impeller for a cross-flow fan in which the blades are mounted on the impeller at non-uniform pitch angles, with substantial elimination of the disadvantages inherent in conventional impellers of this kind.

Another important object of the present invention is to provide an improved impeller of the above described type which is highly reliable in actual use.

In accomplishing these and other objects according to one preferred embodiment of the present invention, there is provided an improved impeller for a cross-flow fan, including at least one impeller section, said impeller section comprising: a pair of circular plate members which confront each other so as to be spaced at a predetermined interval; and a number of blades which are mounted, at opposite ends thereof, on said plate members along circumferences of said plate members so as to extend between said plate members such that said blades are circumferentially spaced at random pitch angles without periodicity.

In accordance with the present invention, since the blades are arranged at non-uniform pitch angles, the interference noises are produced at non-uniform pitches by the respective blades, and their frequencies vary according to the non-uniform pitch angles, and the number of different frequencies is equal to the number of different pitch angles so that the frequencies are dispersed among various values and thus, the peak value of the noise level drops, whereby the auditory feeling of human ears subjected to the noises is improved.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 2:
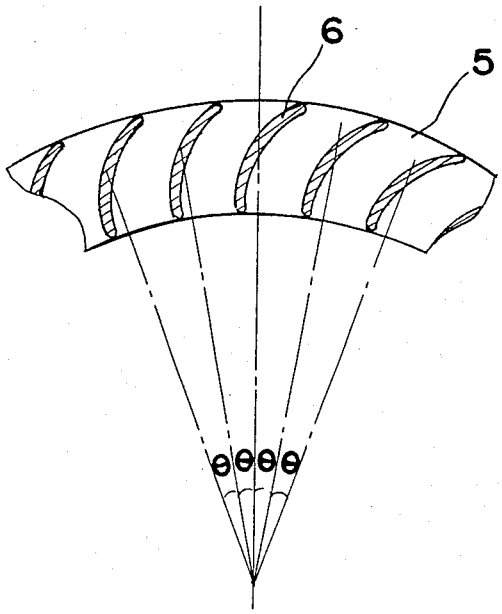
Fig. 2 PRIOR ART
FIG. 2 is a cross-sectional view showing, on an enlarged scale, a main portion of a prior art impeller employed in the prior art cross-flow fan of FIG. 1 (already referred to)
Figure 3:
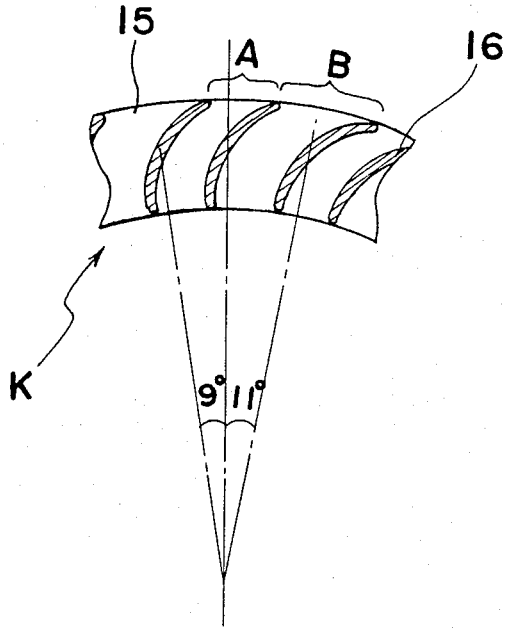
FIG. 3 is a view similar to FIG. 2, particularly showing a main portion of an impeller according to the present invention.

Referring now to the drawings, there is shown in FIG. 3, an impeller K for a cross-flow fan, according to the present invention, which includes a number of blades 16. It should be noted here that an essential characteristic of the present invention resides in that the blades 16 are arranged non-uniformly at random pitch angles as shown in FIG. 3 in contrast with the known impeller 1 of FIG. 2 in which the blades 6 are arranged at the uniform pitch angle $\theta$. Other constructions of the impeller K are generally similar to those of the prior art impeller 1 of FIG. 2 and therefore, are not specifically described here for the sake of brevity. Thus, it will be readily understood that the impeller K includes a pair of end plates (not shown) disposed at opposite ends thereof and a plurality of partition plates 15 interposed between the end plates such that adjacent ones of the end plates and the partition plates 15, which are spaced at a predetermined interval, are coupled, along outer peripheral portions thereof, with each other by the blades 16. Assuming here that $\phi$ denotes the random pitch angles of the blades 16, one example of the random pitch angles $\phi$ is given as shown in Table 1 below.

TABLE 1

| Blade number | Pitch angle $\phi$ | Blade number | Pitch angle $\phi$ |
|---|---|---|---|
| 1 | 9.2 | 19 | 11.7 |
| 2 | 10.2 | 20 | 11.2 |
| 3 | 11.7 | 21 | 10.7 |
| 4 | 11.7 | 22 | 11.7 |
| 5 | 10.7 | 23 | 11.2 |
| 6 | 9.7 | 24 | 10.7 |
| 7 | 8.7 | 25 | 8.7 |
| 8 | 10.2 | 26 | 9.7 |
| 9 | 10.7 | 27 | 10.2 |
| 10 | 9.7 | 28 | 11.2 |
| 11 | 10.7 | 29 | 10.2 |
| 12 | 10.2 | 30 | 9.7 |
| 13 | 9.7 | 31 | 11.2 |
| 14 | 8.7 | 32 | 9.2 |
| 15 | 9.7 | 33 | 9.7 |
| 16 | 9.7 | 34 | 11.7 |
| 17 | 10.7 | 35 | 10.7 |
| 18 | 8.7 | | |

Figure 4A:
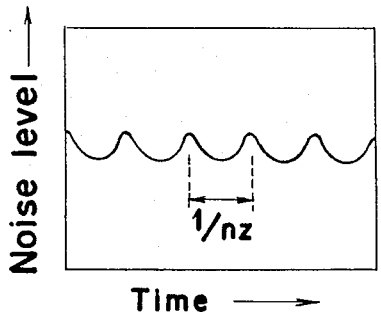
Fig. 4a PRIOR ART
FIGS. 4*a* and 4*b* are graphs explanatory of relations between time and noise level in the prior art impeller of FIG. 2 and in the impeller of the present invention of FIG. 3, respectively.
Figure 4B:
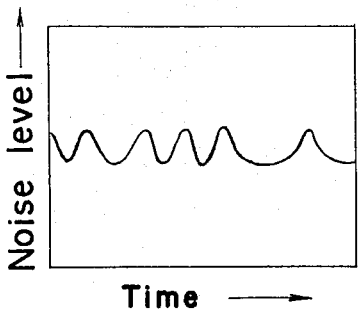

Referring to FIG. 3, the random pitch angles $\phi$ stand at respective 9° and 11° at portions A and B of one of the partition plates 15. Thus, frequencies of nz noises produced at the portions A and B assume values of $360\times n/9$ and $360\times n/11$, respectively (n and z denoting the rate of revolutions of the impeller K and the rate of the blades 16, respectively). Thus, the nz noises, having different frequencies inversley proportional to the random pitch angles $\theta$ and equal in number to the number of different pitches angles $\theta$, are produced by the impeller K at non-uniform intervals as shown in FIG. 4*b*.

Figure 1:
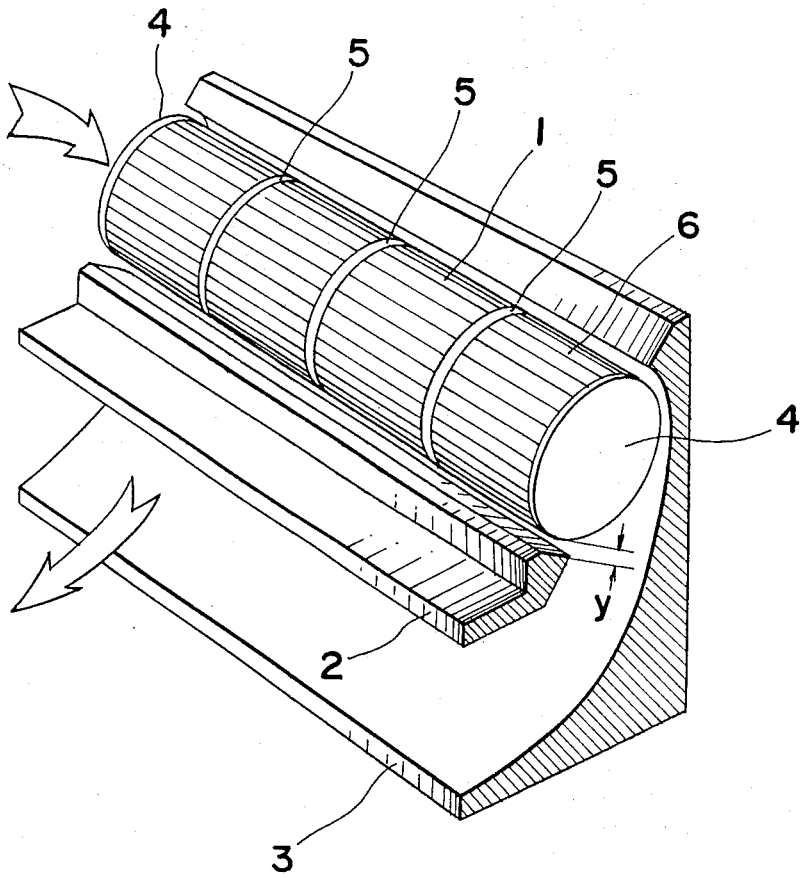
Fig. 1 PRIOR ART
FIG. 1 is a cutaway perspective view of a prior art cross-flow fan (already referred to)
Figure 5A:
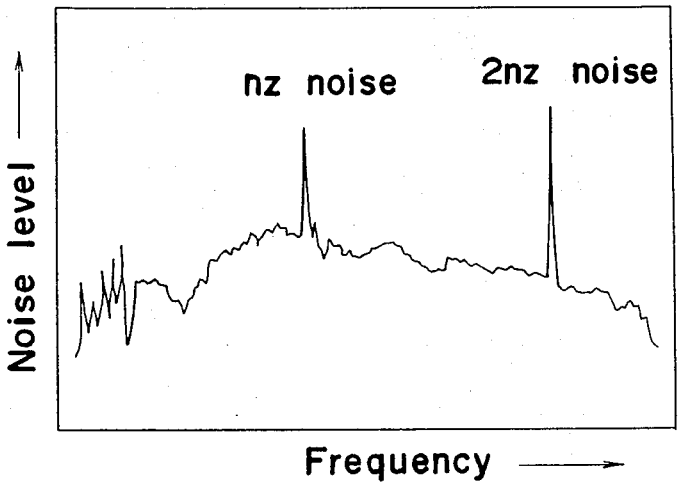
Fig. 5a PRIOR ART
FIGS. 5*a* and 5*b* are graphs explanatory of relations between frequency and noise level in the prior art impeller of FIG. 2 and in the impeller of the present invention of FIG. 3, respectively.
Figure 5B:
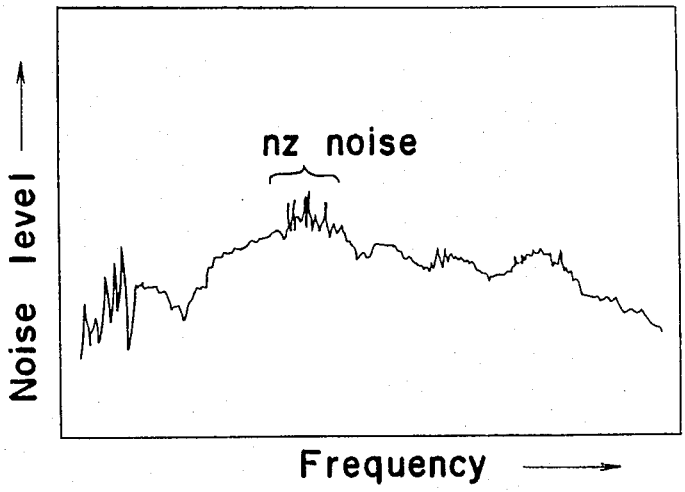

FIG. 5*a* shows frequency characteristics indicative of the nz noises and the harmonics, i.e. 2 nz noises produced by the known impeller 1 of FIG. 1 referred to earlier. It will be readily seen from FIG. 5*a* that two extremely high peaks appear in the nz noises of the prior art impeller 1. When the nz noises are produced by the known impeller 1, they are received, as high pitch noises like whistling sounds, by human ears. On the other hand, FIG. 5*b* shows frequency characteristics indicative of the nz noises produced by the impeller K. In FIG. 5*b*, there are a number of low peaks. Even if the nz noises are produced by the impeller K, they are mixed with other noises so as to be substantially inaudible to human ears.

It is to be noted that there is neither any increase in noise at other frequencies nor deterioration of performance of air flow in the impeller K in comparison with prior art impellers in the case where other dimensions and the number of the blades 16 of the impeller K are equal to those of the prior art impellers.

Furthermore, selection and arrangement of the random pitch angles $\theta$ of the blades 16 are, needless to say, not limited to those of Table 1 but can be performed in innumerable other ways than that of Table 1. In the case where some of the blades 16, the random pitch angles $\phi$ between adjacent ones of which are small, are concentrated at one portion of the impeller K, the weight of the blades 16 is concentrated at this portion, so that the center of gravity of the impeller K deviates far away from the rotational axis of the impeller K, thereby resulting in imbalance of rotation of the impeller K. Assuming that a blade number i has a pitch angle $\phi i$, that $\phi Ii$ denotes an integrated pitch angle $$\sum_{j=1}^{i} \phi j,$$

and that z denotes the number of the blades 16, a quantity U acting as an index for indicating the degree of imbalance of rotation of the impeller K in the case of one arrangement of the blades 16, is given by:

$$U = \left\{ \left( \sum_{i=1}^{z} \cos\phi Ii \right)^2 + \left( \sum_{i=1}^{z} \sin\phi Ii \right)^2 \right\}^{\frac{1}{2}} \quad (1)$$

Experiments conducted by the present inventors have revealed that an imbalance of rotation of the impeller K rarely takes place when the quantity U is less than 1.

Furthermore, the blades 16 are required to be arranged without any periodicity. For example, when the impeller K is circumferentially divided into p portions each having an identical random arrangement of the blades 16, such an undesirable phenomenon takes place that high beat noises of a frequency of np are produced for an angle of 360/p deg. corresponding to one period. In the case where a small value of, for example, 2 or 3 is assigned to p, large beat noises are produced. Meanwhile, in the case where a large value of, for example, 10 to 18 is assigned to p, the effect of the random arrangement of the blades 16 is spoiled with a consequent production of high nz noises.

Consequently, the impeller K of the present invention is formed by a plurality of impeller sections axially coupled with each other and each having the blades arranged at random taking into account the above described conditions. In this connection, care should be given to relative angular positions of axially adjacent ones of the impeller sections of the impeller K because high harmonics for the rate n of revolution are produced when the blades of adjacent ones of the impeller sections are aligned with each other in the axial direction of the impeller K. More specifically, the blades of adjacent ones of the impeller sections, which are aligned with each other within a range of ±1°, are referred to here as overlapping blades. When the number of the overlapping blades between each pair of adjacent ones of the impeller sections is 5 or less, it was found that low frequency harmonics are produced. Meanwhile, when the number of the overlapping blades between adjacent ones of the impeller sections is 15 or more, it was found that high frequency harmonics are produced, thus causing extremely severe discomfort to human ears.

As is clear from the foregoing description, in accordance with the present invention, such a serious disadvantage inherent in the prior art cross-flow fans that the high nz noises are produced can be reduced drastically by a remarkably simple method without any increase of other noises or drop in efficiency. Furthermore, in accordance with the present invention, it becomes possible to design positions and shapes of the stabilizer and the rear guider more freely than in the known cross-flow fans, which design has been restricted severely in the case of the known cross-flow fans in order to repress the nz noises. Thus, the performance of the fan has been improved remarkably.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as being included therein.

What is claimed is:

1. An impeller for a cross-flow fan, comprising:

a plurality of successively adjacent, parallel confronting circular plate members, at least three in number, axially spaced along a rotational axis extending perpendicularly through the respective centers of said plate members; and a plurality of axially coupled blade sections, each defined between a respective successively adjacent pair of said plate members and including a respective plurality of blades, substantially greater than five in number extending radially outwardly of said axis between, and mounted at opposite axial ends thereof to, said successively adjacent pair of plate members, the blades of each of said blade sections being circumferentially spaced at respective random pitch angles about said axis without periodicity;

no more than five of said blades of each of said blade sections being angularly located about said axis so as to be angularly aligned within 1° of any of the blades of an adjacent one of said blade sections.

2. An impeller as in claim 1, wherein, for each of said blade sections, if the number of blades in said each section is represented by z, the blades being numbered in angular succession, i=1, . . . ,z, the angular location $\phi Iz$ of the zth blade about said axis being designated as having an angular location $\phi Iz=0$ and the angular location of the ith blade with respect to the zth blade being represented by $\phi Ii$, then $$\left\{\left(\sum_{i=1}^{z}\cos\phi Ii\right)^2+\left(\sum_{i=1}^{z}\sin\phi Ii\right)^2\right\}^{\frac{1}{2}}<1.$$

3. An impeller as in claim 1, wherein the arrangement of random pitch angles of each of said blade sections is different from that of the remainder of said blade sections.

4. An impeller as in claim 2, wherein the arrangement of random pitch angles of each of said blade sections is different from that of the remainder of said blade sections.

5. An impeller as in claim 1, wherein none of said blades of each of said blade sections is angularly located about said axis so as to be angularly aligned within 1° of any of the blades of an adjacent one of said blade sections.

* * * * *